US010829885B2

(12) United States Patent
Welch

(10) Patent No.: US 10,829,885 B2
(45) Date of Patent: Nov. 10, 2020

(54) DRAIN PUMP ASSEMBLY FOR A WASHING MACHINE APPLIANCE AND METHODS OF OPERATING THE SAME

(71) Applicant: Haier US Appliance Solutions, Inc., Wilmington, DE (US)

(72) Inventor: Aaron Lee Welch, Louisville, TX (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 199 days.

(21) Appl. No.: 16/055,217

(22) Filed: Aug. 6, 2018

(65) Prior Publication Data

US 2020/0040512 A1 Feb. 6, 2020

(51) Int. Cl.

| | |
|---|---|
| ***D06F 33/02*** | (2006.01) |
| ***D06F 39/08*** | (2006.01) |
| ***D06F 33/00*** | (2020.01) |
| ***D06F 34/18*** | (2020.01) |
| ***D06F 34/22*** | (2020.01) |
| ***D06F 34/28*** | (2020.01) |

(52) U.S. Cl.

CPC ..... *D06F 39/085* (2013.01); *D06F 33/00* (2013.01); *D06F 34/18* (2020.02); *D06F 34/22* (2020.02); *D06F 34/28* (2020.02); *D06F 39/087* (2013.01)

(58) Field of Classification Search

CPC ..... D06F 39/085; D06F 39/087; D06F 34/22; D06F 34/18; D06F 33/00

USPC ..... 68/12.19

See application file for complete search history.

(56) References Cited

U.S. PATENT DOCUMENTS

| | | | | |
|---|---|---|---|---|
| 3,139,633 | A | 7/1964 | Fecho et al. | |
| 4,916,768 | A | 4/1990 | Broadbent | |
| 5,167,722 | A | 12/1992 | Pastryk et al. | |
| 5,199,127 | A | 4/1993 | Van Newenhizen et al. | |
| 9,689,107 | B2 | 6/2017 | Joo | |
| 2002/0116959 | A1* | 8/2002 | Ohta | D06F 34/28 68/12.27 |
| 2004/0211228 | A1* | 10/2004 | Nishio | D06F 25/00 68/12.05 |
| 2015/0368849 | A1* | 12/2015 | Pessot | D06F 39/087 68/17 R |
| 2017/0122304 | A1* | 5/2017 | Funabashi | H02P 6/16 |
| 2017/0356116 | A1* | 12/2017 | Kwak | D06F 23/02 |

FOREIGN PATENT DOCUMENTS

| | | | |
|---|---|---|---|
| CN | 106702662 | A | 5/2017 |
| EP | 2993262 | B1 | 11/2017 |

* cited by examiner

*Primary Examiner* — Tinsae B Ayalew
(74) *Attorney, Agent, or Firm* — Dority & Manning, P.A.

(57) ABSTRACT

A washing machine appliance includes a sump for collecting wash fluid and a drain pump assembly for selectively draining that wash fluid in response to sump pressures measured by a water level detection system. Specifically, a controller is configured for operating the drain pump assembly to perform a drain cycle and obtaining a sump pressure after the drain cycle. A variable flag is set to a first state if the measured pressure exceeds a predetermined threshold pressure, which indicates that a certain amount of wash fluid is present in the sump. During a subsequent operating cycle, the drain pump assembly will be operated at the start of the cycle only if the variable flag was set to the first state during the prior operating cycle.

20 Claims, 6 Drawing Sheets

DRAIN PUMP ASSEMBLY FOR A WASHING MACHINE APPLIANCE AND METHODS OF OPERATING THE SAME

FIELD OF THE INVENTION

The present subject matter relates generally to drain pump assemblies for washing machine appliances, or more specifically, to methods for selectively operating a drain pump assembly at a beginning of a wash cycle.

BACKGROUND OF THE INVENTION

Washing machine appliances generally include a tub for containing water or wash fluid, e.g., water and detergent, bleach, and/or other wash additives. A basket is rotatably mounted within the tub and defines a wash chamber for receipt of articles for washing. During normal operation of such washing machine appliances, the wash fluid is directed into the tub and onto articles within the wash chamber of the basket. The basket or an agitation element can rotate at various speeds to agitate articles within the wash chamber, to wring wash fluid from articles within the wash chamber, etc. During a spin or drain cycle, a drain pump assembly may operate to discharge water from within sump.

Conventional washing machine appliances may include water level detection systems for detecting the amount of water remaining within the sump after a drain cycle. For example, the water level may be measured to detect drainage issues, such as a drain pump failure, and to determine the how much water must be added in a subsequent wash cycle to reach a target water level. However, such water level detection systems may not operate accurately over time if left submerged between cycles. For example, water level detection systems may include pressure sensors coupled to pressure hoses on the sump which may bleed air over time. As air bleeds out of the pressure hoses, the pressure sensor may drift back towards an indication of zero pressure, even when water remains within the sump.

Due to potential erroneous pressure and water level readings, conventional washing machine appliances may be configured for running a drain cycle at the beginning of every wash cycle, e.g., to ensure there is no water in the sump and to properly calibrate the pressure sensor or water level detection system. However, operating the drain pump assembly prior to every cycle increases energy usage, cycle time, and noise levels, all of which may be irritating to a consumer.

Accordingly, a washing machine appliance having improved features for determining the water level in the sump would be desirable. More particularly, a washing machine appliance with a water level detection system and methods of operation which reduce energy usage, cycle times, and noise would be particularly beneficial.

BRIEF DESCRIPTION OF THE INVENTION

Advantages of the invention will be set forth in part in the following description, or may be apparent from the description, or may be learned through practice of the invention.

In accordance with one exemplary embodiment of the present disclosure, a washing machine appliance is provided including a sump for collecting wash fluid and a drain pump assembly in fluid communication with the sump for selectively draining the wash fluid collected within the sump. A water level detection system includes an air chamber fluidly coupled to the sump and a pressure sensor for measuring a chamber pressure and a controller is operably coupled to the water level detection system and the drain pump assembly. The controller is configured for operating the drain pump assembly to perform a drain cycle to discharge the wash fluid from the sump, obtaining the chamber pressure using the water level detection system after performing the drain cycle, setting a variable flag to a first state if the chamber pressure exceeds a predetermined threshold pressure, and operating the drain pump assembly at the beginning of a subsequent operating cycle only if the variable flag is set to the first state.

In accordance with another exemplary embodiment of the present disclosure, a method of operating a drain pump assembly of a washing machine appliance is provided. The washing machine appliance includes a sump for collecting wash fluid and a water level detection system comprising an air chamber fluidly coupled to the sump and a pressure sensor for measuring a chamber pressure. The method includes operating the drain pump assembly to perform a drain cycle to discharge the wash fluid from the sump, obtaining the chamber pressure using the water level detection system after performing the drain cycle, setting a variable flag to a first state if the chamber pressure exceeds a predetermined threshold pressure, and operating the drain pump assembly at the beginning of a subsequent operating cycle only if the variable flag is set to the first state.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
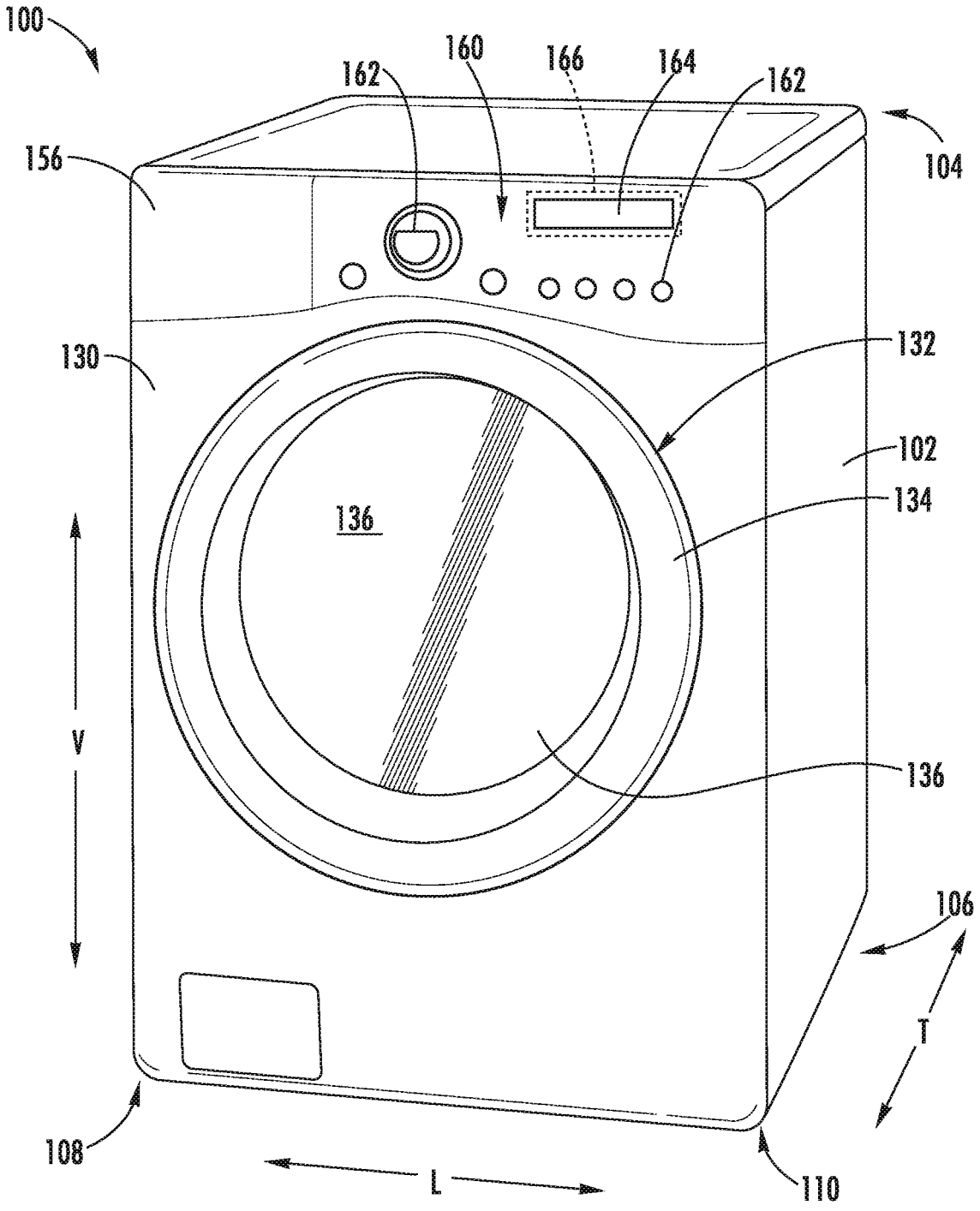
FIG. 1 provides a perspective view of an exemplary washing machine appliance according to an exemplary embodiment of the present subject matter.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
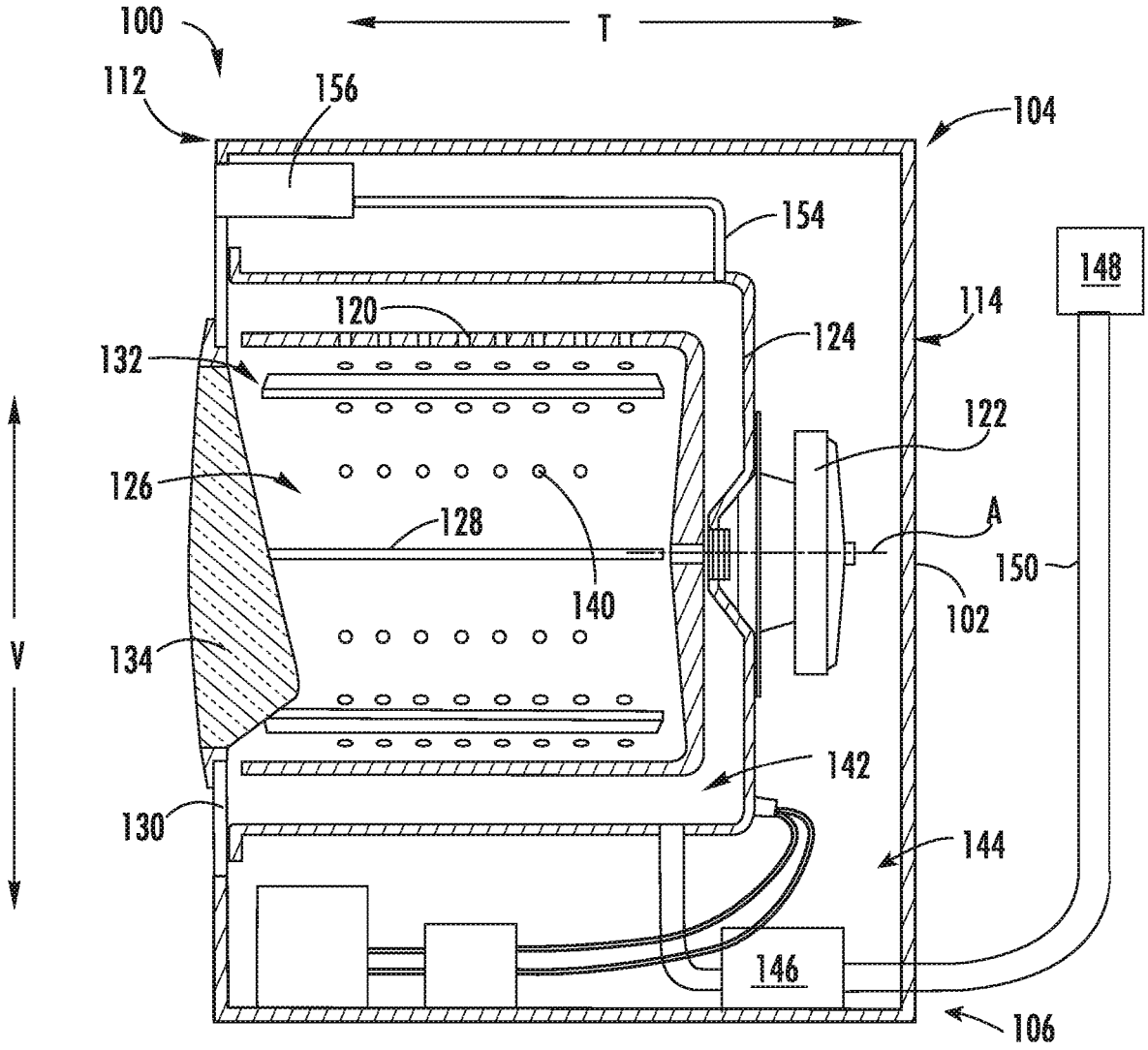
FIG. 2 provides a side cross-sectional view of the exemplary washing machine appliance of FIG. 1.

Referring now to the figures, FIG. 1 is a perspective view of an exemplary horizontal axis washing machine appliance 100 and FIG. 2 is a side cross-sectional view of washing machine appliance 100. As illustrated, washing machine appliance 100 generally defines a vertical direction V, a lateral direction L, and a transverse direction T, each of which is mutually perpendicular, such that an orthogonal coordinate system is generally defined. Washing machine appliance 100 includes a cabinet 102 that extends between a top 104 and a bottom 106 along the vertical direction V, between a left side 108 and a right side 110 along the lateral direction, and between a front 112 and a rear 114 along the transverse direction T.

Referring to FIG. 2, a wash basket 120 is rotatably mounted within cabinet 102 such that it is rotatable about an axis of rotation A. A motor 122, e.g., such as a pancake motor, is in mechanical communication with wash basket 120 to selectively rotate wash basket 120 (e.g., during an agitation or a rinse cycle of washing machine appliance 100). Wash basket 120 is received within a wash tub 124 and defines a wash chamber 126 that is configured for receipt of articles for washing. The wash tub 124 holds wash and rinse fluids for agitation in wash basket 120 within wash tub 124. As used herein, "wash fluid" may refer to water, detergent, fabric softener, bleach, or any other suitable wash additive or combination thereof. Indeed, for simplicity of discussion, these terms may all be used interchangeably herein without limiting the present subject matter to any particular "wash fluid."

Wash basket 120 may define one or more agitator features that extend into wash chamber 126 to assist in agitation and cleaning articles disposed within wash chamber 126 during operation of washing machine appliance 100. For example, as illustrated in FIG. 2, a plurality of ribs 128 extends from basket 120 into wash chamber 126. In this manner, for example, ribs 128 may lift articles disposed in wash basket 120 during rotation of wash basket 120.

Referring generally to FIGS. 1 and 2, cabinet 102 also includes a front panel 130 which defines an opening 132 that permits user access to wash basket 120 of wash tub 124. More specifically, washing machine appliance 100 includes a door 134 that is positioned over opening 132 and is rotatably mounted to front panel 130. In this manner, door 134 permits selective access to opening 132 by being movable between an open position (not shown) facilitating access to a wash tub 124 and a closed position (FIG. 1) prohibiting access to wash tub 124.

A window 136 in door 134 permits viewing of wash basket 120 when door 134 is in the closed position, e.g., during operation of washing machine appliance 100. Door 134 also includes a handle (not shown) that, e.g., a user may pull when opening and closing door 134. Further, although door 134 is illustrated as mounted to front panel 130, it should be appreciated that door 134 may be mounted to another side of cabinet 102 or any other suitable support according to alternative embodiments.

Referring again to FIG. 2, wash basket 120 also defines a plurality of perforations 140 in order to facilitate fluid communication between an interior of basket 120 and wash tub 124. A sump 142 is defined by wash tub 124 at a bottom of wash tub 124 along the vertical direction V. Thus, sump 142 is configured for receipt of and generally collects wash fluid during operation of washing machine appliance 100. For example, during operation of washing machine appliance 100, wash fluid may be urged by gravity from basket 120 to sump 142 through plurality of perforations 140.

A drain pump assembly 144 is located beneath wash tub 124 and is in fluid communication with sump 142 for periodically discharging soiled wash fluid from washing machine appliance 100. Drain pump assembly 144 may generally include a drain pump 146 which is in fluid communication with sump 142 and with an external drain 148 through a drain hose 150. During a drain cycle, drain pump 146 urges a flow of wash fluid from sump 142, through drain hose 150, and to external drain 148. More specifically, drain pump 146 includes a motor (not shown) which is energized during a drain cycle such that drain pump 146 draws wash fluid from sump 142 and urges it through drain hose 150 to external drain 148. Notably, external drain 148 is typically positioned above drain pump 146 along the vertical direction V. Therefore, wash fluid that is pumped out of sump 142 but which does not reach external drain 148 has a tendency to fall under the force of gravity back into sump 142 when drain pump 146 stops operating.

A spout 154 is configured for directing a flow of fluid into wash tub 124. For example, spout 154 may be in fluid communication with a water supply (not shown) in order to direct fluid (e.g., clean water) into wash tub 124. Spout 154 may also be in fluid communication with the sump 142. For example, pump assembly 144 may direct wash fluid disposed in sump 142 to spout 154 in order to circulate wash fluid in wash tub 124.

As illustrated in FIG. 2, a detergent drawer 156 is slidably mounted within front panel 130. Detergent drawer 156 receives a wash additive (e.g., detergent, fabric softener, bleach, or any other suitable liquid or powder) and directs the fluid additive to wash chamber 124 during operation of washing machine appliance 100. According to the illustrated embodiment, detergent drawer 156 may also be fluidly coupled to spout 154 to facilitate the complete and accurate dispensing of wash additive.

A control panel 160 including a plurality of input selectors 162 is coupled to front panel 130. Control panel 160 and input selectors 162 collectively form a user interface input for operator selection of machine cycles and features. For example, in one embodiment, a display 164 indicates selected features, a countdown timer, and/or other items of interest to machine users.

Operation of washing machine appliance 100 is controlled by a controller or processing device 166 (FIG. 1) that is operatively coupled to control panel 160 for user manipulation to select washing machine cycles and features. In response to user manipulation of control panel 160, controller 166 operates the various components of washing machine appliance 100 to execute selected machine cycles and features.

Controller 166 may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 166 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 160 and other components of washing machine appliance 100 may be in communication with controller 166 via one or more signal lines or shared communication busses.

During operation of washing machine appliance 100, laundry items are loaded into wash basket 120 through opening 132, and washing operation is initiated through operator manipulation of input selectors 162. Wash tub 124 is filled with water, detergent, and/or other fluid additives, e.g., via spout 154 and or detergent drawer 156. One or more valves (not shown) can be controlled by washing machine appliance 100 to provide for filling wash basket 120 to the appropriate level for the amount of articles being washed and/or rinsed. By way of example for a wash mode, once wash basket 120 is properly filled with fluid, the contents of wash basket 120 can be agitated (e.g., with ribs 128) for washing of laundry items in wash basket 120.

After the agitation phase of the wash cycle is completed, wash tub 124 can be drained. Laundry articles can then be rinsed by again adding fluid to wash tub 124, depending on the particulars of the cleaning cycle selected by a user. Ribs 128 may again provide agitation within wash basket 120. One or more spin cycles may also be used. In particular, a spin cycle may be applied after the wash cycle and/or after the rinse cycle in order to wring wash fluid from the articles being washed. During a final spin cycle, basket 120 is rotated at relatively high speeds and drain pump assembly 144 may discharge wash fluid from sump 142. After articles disposed in wash basket 120 are cleaned and/or washed, the user can remove the articles from wash basket 120, e.g., by opening door 134 and reaching into wash basket 120 through opening 132.

While described in the context of a specific embodiment of horizontal axis washing machine appliance 100, using the teachings disclosed herein it will be understood that horizontal axis washing machine appliance 100 is provided by way of example only. Other washing machine appliances having different configurations, different appearances, and/or different features may also be utilized with the present subject matter as well, e.g., vertical axis washing machine appliances.

Figure 3:
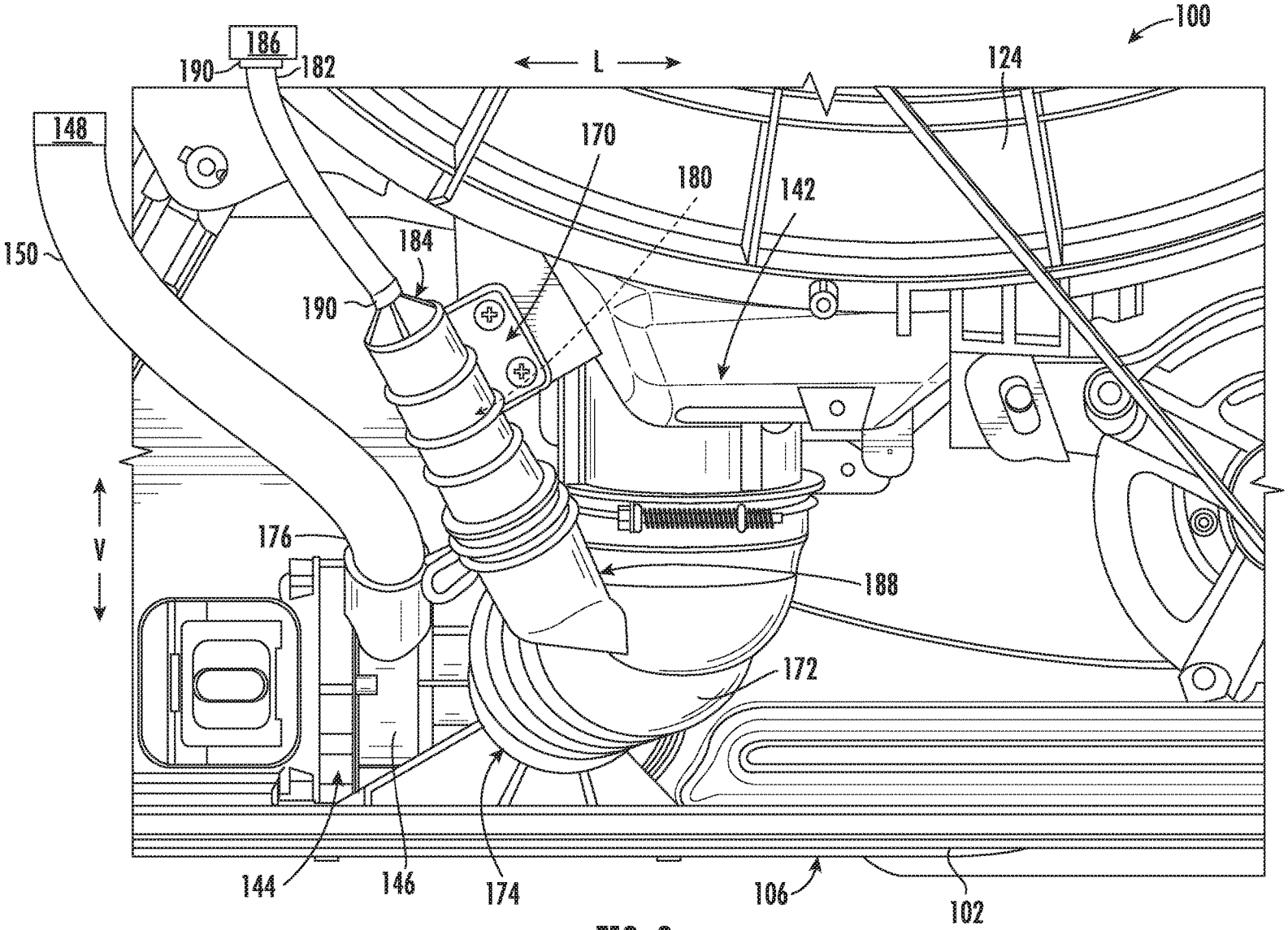
FIG. 3 provides a rear, perspective view of a drain pump assembly and a water level detection system according to an exemplary embodiment of the present subject matter.
Figure 4:
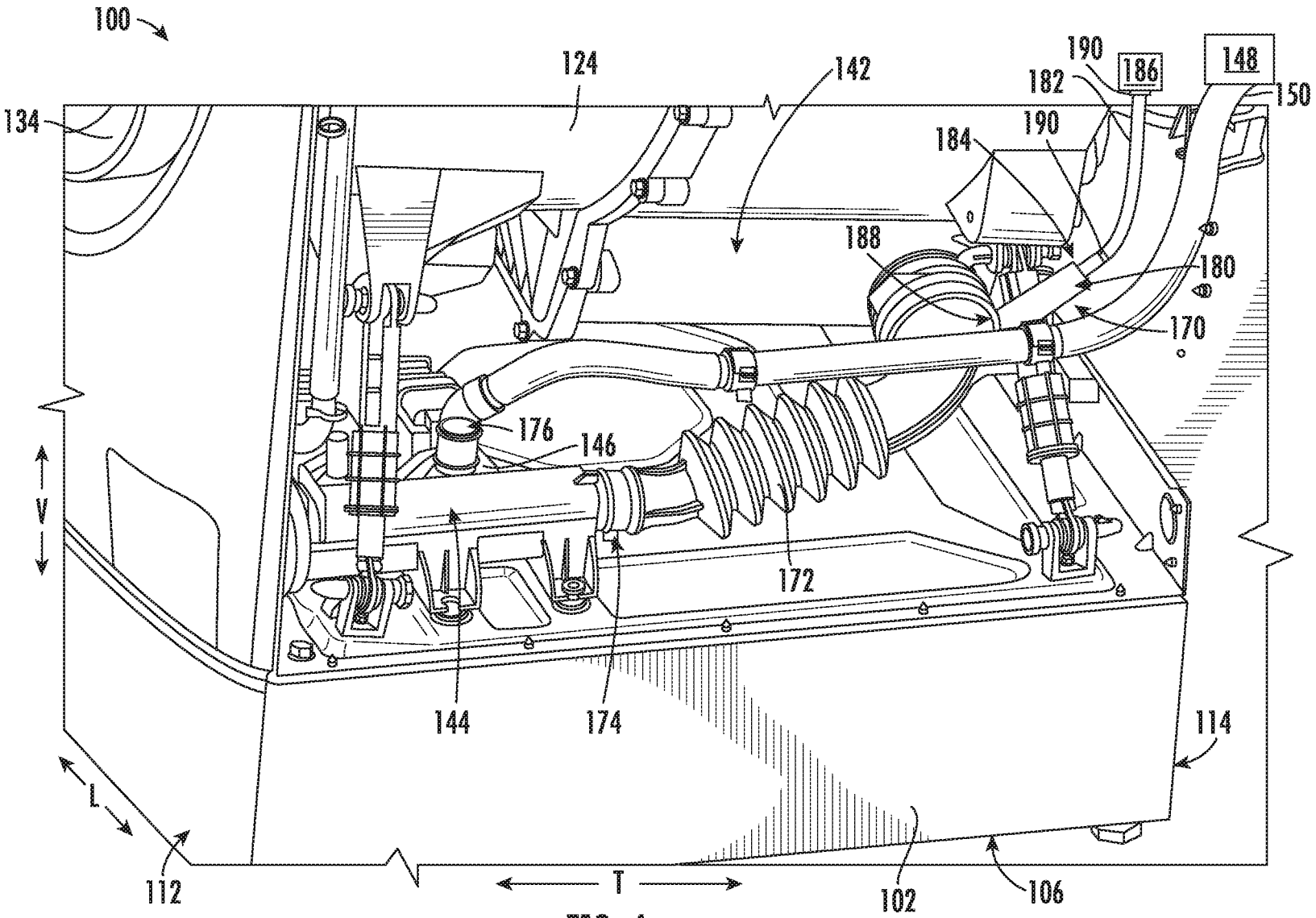
FIG. 4 provides a side, perspective view of the exemplary drain pump assembly and water level detection system of FIG. 3.

Referring now to FIGS. 3 and 4, a water level detection system 170 that may be used within washing machine appliance 100 will be described according to an exemplary embodiment. Specifically, FIGS. 3 and 4 provide rear perspective and side perspective views, respectively, of water level detection system 170 operably coupled to a drain pump assembly (e.g., drain pump assembly 144). However, water level detection system 170 as described herein is only one exemplary configuration used for the purpose of explaining aspects of the present subject matter and is not intended to limit the scope of the invention in any manner.

As illustrated, sump 142 defines a drain basin at a lowest point of wash tub 124 for collecting wash fluid under the force of gravity. A sump hose 172 extends between sump 142 and an intake 174 of drain pump 146. According to the illustrated embodiment, drain pump 146 is a positive displacement pump configured for urging wash fluid that collects in sump 142 and sump hose 172 through a pump discharge 176, through drain hose 150, and to external drain 148. However, it should be appreciated that the drain pump assembly 144 and the sump drainage configuration illustrated herein are only exemplary and not intended to limit the scope of the present subject matter. For example, drain pump 146 may have a different configuration or position, may include one or more filtering mechanisms, etc.

Water level detection system 170 may generally include an air chamber 180 that extends from sump hose 172 (or another suitable portion of sump 142) at least partially upward along the vertical direction V. A pressure hose 182 is fluidly coupled to a top end 184 of air chamber 180 and extends to a pressure sensor 186. In general, pressure sensor 186 may be any sensor suitable for determining a water level within sump 142 based on pressure readings. According to exemplary embodiments, pressure sensor 186 is positioned proximate top 104 of cabinet 102, e.g., proximate or mounted to control panel 160. Thus, pressure hose 182 extends from air chamber 180 (i.e., proximate bottom 106 of cabinet 102) upward along the vertical direction V to pressure sensor 186.

Water level detection system 170 and pressure sensor 186 generally operate by measuring a pressure of air within air chamber 180 and using the measured chamber pressure to estimate the water level in sump 142. For example, when the water level within sump 142 falls below a chamber inlet 188, the pressure within air chamber 180 normalizes to ambient or atmospheric pressure, and thus reads a zero pressure. However, when water is present in sump 142 and rises above chamber inlet 188, the measured air pressure becomes positive and may increase proportionally with the water level. Although sump 142 is described herein as containing water, it should be appreciated that aspects of the present subject matter may be used for detecting the level of any other suitable wash fluid.

Under normal operating conditions, e.g., when drain pump assembly 144 is operating properly and when the appliance installation uses a normal or short length drain hose 150, pump assembly 144 may pump a sufficient amount of the collected water out of the pump and into external drain 148, such that sump 142 may be deemed empty. Specifically, for example, the level of water remaining within sump 142 in such a situation may fall below chamber inlet 188 of air chamber 180. In this manner, pressure sensor 186 may indicate a normalized or non-elevated air pressure (e.g., a measured pressure equivalent to atmospheric pressure), which is indicative of an empty sump 142. Thus, at the initiation of the next wash cycle, controller 166 may know that sump 142 is empty (or at least below a threshold level) and may fill sump 142 to the target level.

By contrast, in certain situations, the level of water within sump 142 after a drain cycle may be sufficient to consider the sump 142 as submerged or otherwise filled above a threshold level. Specifically, for example, if drain pump assembly 144 is malfunctioning or the appliance installation uses a very long drain hose 150 that extends high above sump 142, the entire column of water that remains in drain hose 150 which has not passed into external drain 148 when drain pump 146 is turned off will fall under the force of gravity and collect within sump 142. In such a situation, air chamber 180 may be submerged or chamber inlet 188 may be blocked, thus preventing air from entering air chamber 180 to normalize pressure sensor 186.

Moreover, due to imperfect seals 190 within water level detection system 170, such as a hose seal (FIG. 3) or corresponding seal for coupling pressure hose 182 to pressure sensor 186 (not shown), air may slowly bleed out of pressure hose 182 over time. In this regard, seals 190 of water level detection system may be water-tight but not air-tight, thus permitting slow air leakage. Thus, if sufficient time has passed since the last operating cycle, pressure sensor 186 may indicate that sump 142 is empty when in fact the water remaining within sump 142 is above chamber inlet 188 and some threshold water level (e.g., sump 142 is not empty).

Because water level detection system 170 is used to determine whether a drain cycle should be performed prior to a subsequent wash cycle or how much water should be added to reach a target water level, erroneous pressure readings may cause too much water to be added. In addition, a drain cycle may not be performed when one is in fact needed. Therefore, relying on pressure sensor 186 to determine the water level within sump 142 at the beginning of every operating cycle may result in poor appliance operation. Aspects of method 200 described below are aimed at alleviating this problem.

Now that the construction of washing machine appliance 100 and the configuration of controller 166 according to exemplary embodiments have been presented, an exemplary method 200 of operating a washing machine appliance will be described. Although the discussion below refers to the exemplary method 200 of operating washing machine appliance 100, one skilled in the art will appreciate that the exemplary method 200 is applicable to the operation of a variety of other washing machine appliances, such as vertical axis washing machine appliances. In exemplary embodiments, the various method steps as disclosed herein may be performed by controller 166 or a separate, dedicated controller.

Figure 5:
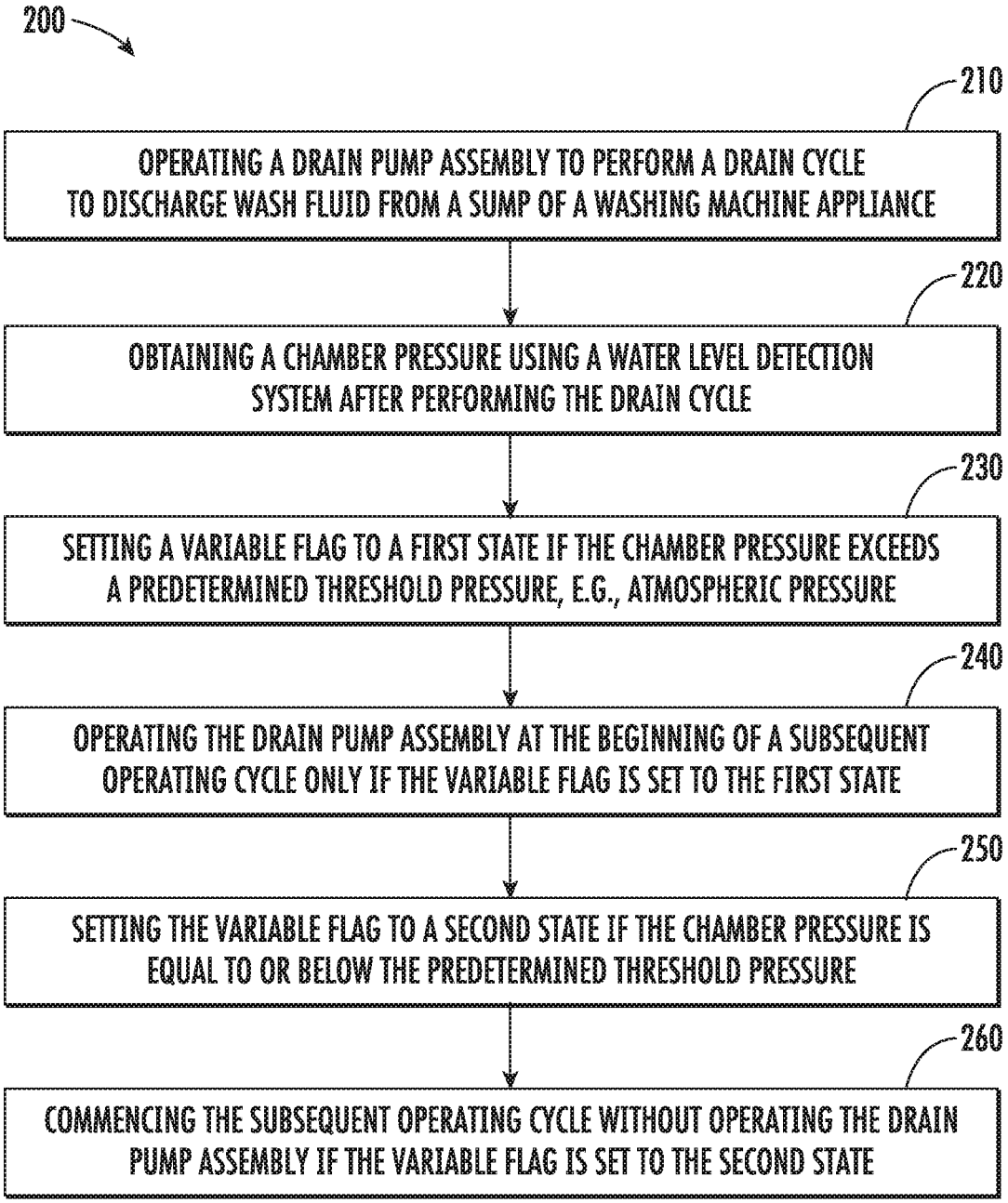
FIG. 5 illustrates a method for controlling a washing machine appliance in accordance with one embodiment of the present disclosure.

Referring now to FIG. 5, method 200 includes, at step 210, operating a drain pump assembly to perform a drain cycle to discharge wash fluid from a sump of a washing machine appliance. For example, continuing the example from above, drain pump assembly 144 may urge wash fluid collected within sump 142 through drain hose 150 to external drain 148. However, as explained above, in certain circumstances wash fluid may collect within sump 142 after drain pump 146 is turned off. It is desirable to know the amount of wash fluid within sump 142 after a drain cycle, e.g., to add a correct amount of wash fluid during a subsequent cycle or to adjust other operating parameters of washing machine appliance 100.

Thus, method 200 includes, at step 220, obtaining the chamber pressure using a water level detection system after performing the drain cycle. According to an exemplary embodiment, it may be desirable to measure the chamber pressure after a predetermined amount of time has passed since the drain cycle was performed or completed, e.g., 5 seconds, 10 seconds, etc. This may be to allow the water flowing from drain hose 250 to collect and stabilize in sump 142. As an example, water level detection system 170 may utilize a pressure sensor 186 operably coupled to an air chamber 180 to measure the chamber pressure.

Notably, for reasons described in detail above, relying on pressure measurements from pressure sensor 186 to make fill determinations for a subsequent operating cycle may frequently result in overfill situations. Therefore, aspects of the present subject matter are directed to setting a variable flag, e.g., which may be stored in software between operating cycles and may be used to make a determination at the start of a subsequent operating cycle as to whether a drain cycle should be a run. Specifically, step 230 includes setting a variable flag to a first state (e.g. a "submerged" or "non-empty" state) if the measured chamber pressure exceeds a predetermined threshold pressure, e.g., the atmospheric pressure surrounding washing machine appliance 100 or another pressure corresponding to a threshold water level. For example, the chamber pressure measured by pressure sensor 186 may be used to determine whether chamber inlet 188 is submerged (e.g., corresponding to a non-empty sump 142) or open to atmosphere (e.g., corresponding to an empty sump 142).

According to an exemplary embodiment, the variable flag may also be set to the first state when certain operating conditions exist. For example, if washing machine appliance 100 is plugged into a power outlet, loses power, or controller 166 is otherwise reset, the variable flag may automatically be set to first state. In this manner, drain pump assembly 144 will perform a drain cycle at the beginning of the next operating cycle, e.g., just in case the power outage or loss has reset the variable flag recorded during a prior operating cycle and water remains in sump 142.

Step 240 includes operating the drain pump assembly at the beginning of a subsequent operating cycle only if the variable flag is set to the first state. In this regard, for example, at the commencement of each operating cycle, controller 166 may obtain the variable flag value from the prior operating cycle. If the variable flag is set to the first state, e.g., indicating that sump 142 was not empty at the end of the prior operating cycle, drain pump 146 may be operated to discharge wash fluid. Alternatively, controller 166 may use the knowledge that water is present in sump 142 to determine an appropriate amount of water to add to reach a target for level. Notably, by relying on the variable flag instead of a pressure reading at the start of each cycle, controller 166 may have a more accurate knowledge of the amount of water present within sump 142.

According to an exemplary embodiment, operating the drain pump assembly during the subsequent operating cycle may include operating the drain pump assembly for a fixed amount of time, e.g., 10 seconds, 20 seconds, etc. The fixed amount of time may be set by a user or by the manufacturer, e.g. based on system configuration, sump size, pump capacity, etc. Notably, as a check to ensure pressure sensor 186 is operating properly after the commencement of a subsequent drain cycle, method 200 may further include measuring a new chamber pressure after operating the drain pump assembly during a subsequent operating cycle. Method 200 may further include determining whether the new chamber pressure still exceeds a predetermined threshold pressure (e.g. atmospheric pressure). If the new chamber pressure still exceeds the predetermined threshold pressure, the drain pump assembly may be operated again for the same fixed amount of time. In addition, if the new chamber pressure continues to exceed the predetermined threshold pressure after repeated drain cycle, a notification may be provided to a user as this may indicate a pump failure, clogged drainage system, etc.

In certain situations, the amount of water remaining within sump 142 after the drain cycle may be below a threshold water level, e.g., corresponding to an empty sump 142. In such a situation, step 250 includes setting the variable flag to a second state (e.g. an "empty" state) if the chamber pressure is equal to or below the predetermined threshold pressure. In this regard, if the water level within sump 142 is below chamber inlet 188, pressure sensor 186 will read atmospheric pressure. Thus, by setting the predetermined threshold pressure at atmospheric pressure, step 250 includes setting the variable flag to the second state. Step 260 includes commencing the subsequent operating cycle without operating the drain pump assembly if the variable flag is set to the second state. Thus, when the variable flag from the prior operating cycle indicates that sump 142 is empty (e.g., the variable flag is in the second state), the time, costs, and noise of operating a drain cycle at the commencement of that subsequent operating cycle may be avoided.

FIG. 5 depicts steps performed in a particular order for purposes of illustration and discussion. Those of ordinary skill in the art, using the disclosures provided herein, will understand that the steps of any of the methods discussed herein can be adapted, rearranged, expanded, omitted, or modified in various ways without deviating from the scope of the present disclosure. Moreover, although aspects of method 200 are explained using washing machine appliance 100 as an example, it should be appreciated that these methods may be applied to the operation of any suitable washing machine appliance.

Figure 6:
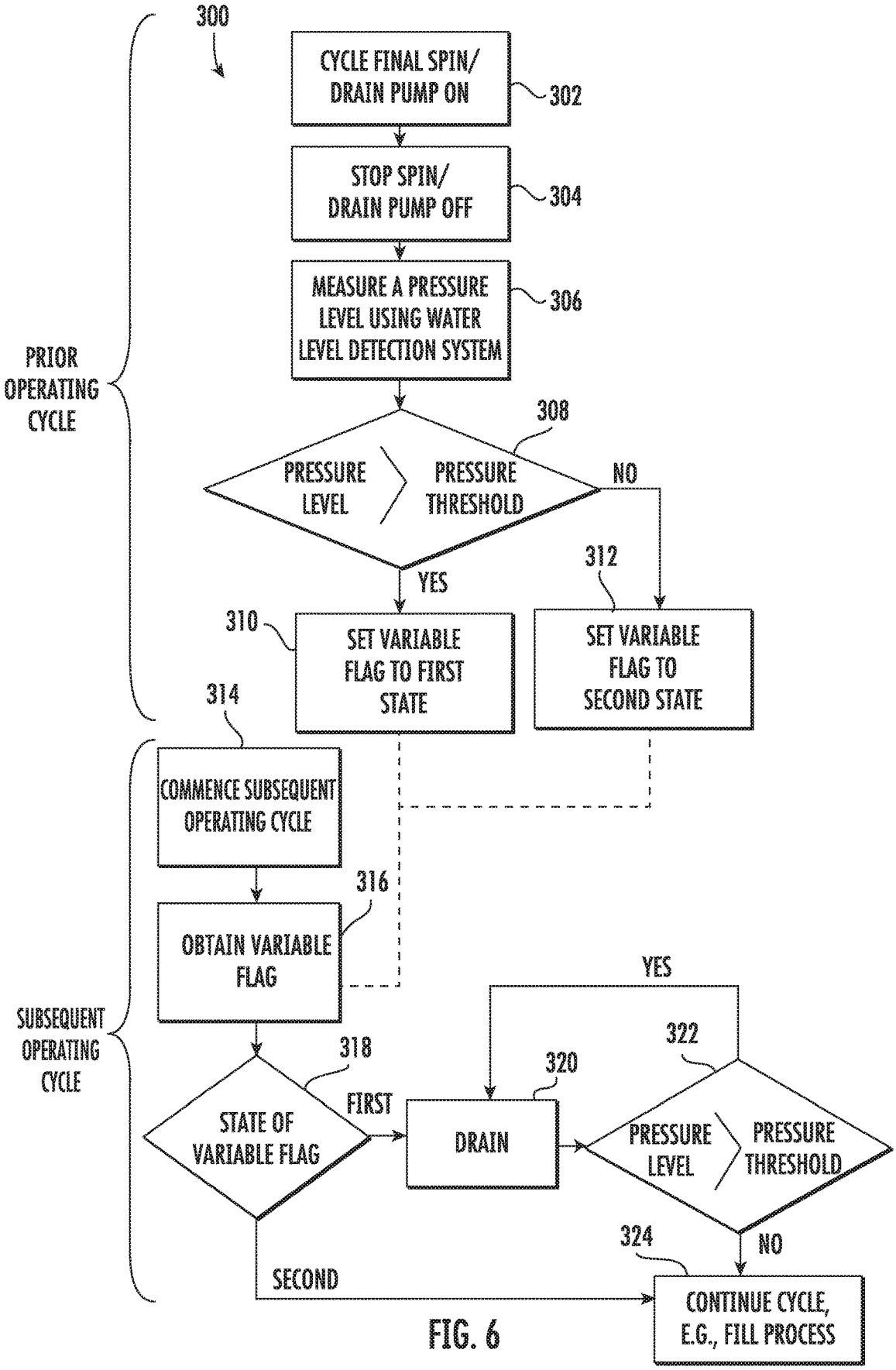
FIG. 6 illustrates an exemplary decision tree or flow diagram of an operating method of the washing machine appliance of FIG. 1 according to an exemplary embodiment of the present subject matter.

Referring now to FIG. 6, an exemplary illustration of the decision making process or control method implemented by controller 166 to perform method 200 is illustrated. It should be appreciated that the flow diagram 300 is intended only to provide a simple illustration of an exemplary control method. The flow diagram 300 is not intended to limit the scope of the present subject matter in any manner.

As shown, at the end of a prior operating cycle, wash machine appliance may enter a final spin cycle during which the drain pump assembly may be turned on to discharge wash fluid collected within the sump (302). After this portion of the cycle is completed, the basket may stop spinning and the drain pump may be turned off (304). After the predetermined amount of time has passed such that wash fluid is permitted to flow out of drain hose back into sump, controller 166 may measure a pressure level within the sump using a water level detection system such as described above (306).

At step 308, the measured pressure level may be compared to a pressure threshold to determine how to set a variable flag. Specifically, if the pressure level exceeds the pressure threshold, the sump 142 is considered to have a threshold level of water or wash fluid contained therein and the variable flag should be set to first state (310). By contrast, if the pressure level is not greater than the pressure threshold, the variable flag should be set to the second state (312), indicating an empty sump. This variable flag may be stored in software until a subsequent operating cycle is performed.

Step 314 includes commencing the subsequent operating cycle. At the start of the cycle, controller 166 may obtain the variable flag from the prior operating cycle (316). At step 318, the state of the variable flag may be used to determine whether a drain cycle is performed at the beginning an operating cycle. Specifically, if the variable flag is in the first state, a drain cycle is performed (320). After the drain cycle, the measured pressure level may be again compared to the pressure threshold (322) to determine whether another drain cycle needs to be run (320) or whether the operating cycle may be continued (324). By contrast, if the state of the variable flag is in the second state at step 318, controller 166 may continue the operating cycle at step 324, e.g., by filling the wash tub with wash fluid, beginning an agitation cycle, etc. It should be appreciated that modifications and variations may be made to method 200 and flow diagram 300 while remaining within the scope of the present subject matter.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A washing machine appliance comprising:

a sump for collecting wash fluid;

a drain pump assembly in fluid communication with the sump for selectively draining the wash fluid collected within the sump;

a water level detection system comprising an air chamber fluidly coupled to the sump and a pressure sensor for measuring a chamber pressure; and a controller operably coupled to the water level detection system and the drain pump assembly, the controller being configured for:

operating the drain pump assembly to perform a drain cycle to discharge the wash fluid from the sump;

obtaining the chamber pressure using the water level detection system after performing the drain cycle;

setting a variable flag to a non-empty state if the chamber pressure exceeds a predetermined threshold pressure;

obtaining, at the beginning of a subsequent operating cycle, the variable flag set after the drain cycle; and operating the drain pump assembly at the beginning of the subsequent operating cycle only if the variable flag is set to the non-empty state.

2. The washing machine appliance of claim 1, wherein the chamber pressure is obtained after a predetermined amount of time has passed since the drain cycle was performed.

3. The washing machine appliance of claim 1, wherein the predetermined threshold pressure is reached when a water level in the sump is sufficient to submerge the air chamber.

4. The washing machine appliance of claim 1, wherein the threshold pressure is atmospheric pressure at the washing machine appliance.

5. The washing machine appliance of claim 1, wherein the air chamber extends at least partially along a vertical direction from a bottom of the sump, the water level detection system further comprising:

a pressure hose fluidly coupled to the air chamber, wherein the pressure sensor is fluidly coupled to the pressure hose for obtaining the chamber pressure within the air chamber.

6. The washing machine appliance of claim 1, wherein the pressure sensor is mounted at a top panel of the washing machine appliance.

7. The washing machine appliance of claim 1, further comprising:

setting the variable flag to an empty state if the chamber pressure is equal to or below the predetermined threshold pressure; and commencing the subsequent operating cycle without operating the drain pump assembly if the variable flag is set to the empty state.

8. The washing machine appliance of claim 1, wherein the drain pump assembly comprises:

a sump hose extending from a bottom or a side of the sump;

a drain pump in fluid communication with the sump hose; and a drain hose fluidly coupling a pump discharge to an external drain.

9. The washing machine appliance of claim 8, wherein operating the drain pump assembly at the beginning of the subsequent operating cycle comprises:

operating the drain pump for a fixed amount of time.

10. The washing machine appliance of claim 9, further comprising:

measuring a new chamber pressure after operating the drain pump assembly at the beginning of the subsequent operating cycle;

determining that the new chamber pressure still exceeds the predetermined threshold pressure; and operating the drain pump assembly again for the fixed amount of time.

11. The washing machine appliance of claim 1, wherein setting the variable flag comprises:

setting the variable flag to the non-empty state if the washing machine appliance has experienced a power loss since the last operating cycle.

12. The washing machine appliance of claim 1, wherein the variable flag remains constant between operating cycles.

13. A method of operating a drain pump assembly of a washing machine appliance, the washing machine appliance comprising a sump for collecting wash fluid and a water level detection system comprising an air chamber fluidly coupled to the sump and a pressure sensor for measuring a chamber pressure, the method comprising:

operating the drain pump assembly to perform a drain cycle to discharge the wash fluid from the sump;

obtaining the chamber pressure using the water level detection system after performing the drain cycle;

setting a variable flag to a non-empty first state if the chamber pressure exceeds a predetermined threshold pressure;

obtaining, at the beginning of a subsequent operating cycle, the variable flag set after the drain cycle; and operating the drain pump assembly at the beginning of the subsequent operating cycle only if the variable flag is set to the non-empty state.

14. The method of claim 13, wherein the chamber pressure is obtained after a predetermined amount of time has passed since the drain cycle was performed.

15. The method of claim 13, wherein the threshold pressure is atmospheric pressure at the washing machine appliance.

16. The method of claim 13, further comprising:

setting the variable flag to an empty state if the chamber pressure is equal to or below the predetermined threshold pressure; and commencing the subsequent operating cycle without operating the drain pump assembly if the variable flag is set to the empty state.

17. The method of claim 13, wherein operating the drain pump assembly at the beginning of the subsequent operating cycle comprises:

operating the drain pump assembly for a fixed amount of time.

18. The method of claim 17, further comprising:

measuring a new chamber pressure after operating the drain pump assembly at the beginning of the subsequent operating cycle;

determining that the new chamber pressure still exceeds the predetermined threshold pressure; and operating the drain pump again for the fixed amount of time.

19. The method of claim 13, wherein setting the variable flag comprises:

setting the variable flag to the non-empty state if the washing machine appliance has experienced a power loss since the last operating cycle.

20. The method of claim 13, wherein the variable flag remains constant between operating cycles.

* * * * *